US011684103B2

(12) United States Patent
Lowder

(10) Patent No.: US 11,684,103 B2
(45) Date of Patent: Jun. 27, 2023

(54) HOODED SUN SHIELD

(71) Applicant: Riff, LLC, Placida, FL (US)

(72) Inventor: Austin Lowder, Placida, FL (US)

(73) Assignee: Riff, LLC, Placida, FL (US)

( * ) Notice: Subject to any disclaimer, the term of this patent is extended or adjusted under 35 U.S.C. 154(b) by 90 days.

(21) Appl. No.: 17/086,067

(22) Filed: Oct. 30, 2020

(65) Prior Publication Data

US 2021/0127773 A1 May 6, 2021

Related U.S. Application Data

(60) Provisional application No. 62/930,274, filed on Nov. 4, 2019.

(51) Int. Cl.

| | |
|---|---|
| ***A42B 1/046*** | (2021.01) |
| ***A41D 31/02*** | (2019.01) |
| ***A41D 27/28*** | (2006.01) |
| ***A41D 13/11*** | (2006.01) |
| ***A41D 31/14*** | (2019.01) |
| ***A42B 1/205*** | (2021.01) |

(52) U.S. Cl.

CPC ..... *A42B 1/046* (2013.01); *A41D 13/11* (2013.01); *A41D 27/28* (2013.01); *A41D 31/02* (2013.01); *A41D 31/145* (2019.02); *A41D 2200/20* (2013.01); *A41D 2300/30* (2013.01); *A41D 2400/26* (2013.01); *A42B 1/205* (2013.01)

(58) Field of Classification Search

CPC .... A41B 1/046; A41D 2400/26; A41D 13/11; A41D 27/28; A41D 13/1153; A41D 13/1161; A42B 1/04; A62B 18/02

See application file for complete search history.

(56) References Cited

U.S. PATENT DOCUMENTS

| | | | | | |
|---|---|---|---|---|---|
| 2,149,067 | A * | 2/1939 | Otero | A41D 13/11 | 128/206.16 |
| 5,704,068 | A * | 1/1998 | Martin | A42B 1/046 | 2/202 |
| 5,727,544 | A * | 3/1998 | Miura | A41D 13/11 | 128/206.16 |
| 5,839,432 | A * | 11/1998 | Daneshvar | A42C 5/04 | 2/205 |

(Continued)

FOREIGN PATENT DOCUMENTS

| | | | | |
|---|---|---|---|---|
| KR | 20130005285 U | * | 11/2013 | A41D 13/11 |
| WO | WO-2020159895 A1 | * | 8/2020 | A41D 23/00 |

OTHER PUBLICATIONS

Fabric, Lexico, accessed via https://www.lexico.com/en/definition/fabric (last visited Mar. 23, 2022) (Year: 2022).*

(Continued)

*Primary Examiner* — Alissa L Hoey
*Assistant Examiner* — Patrick J. Lynch
(74) *Attorney, Agent, or Firm* — Jaffery Watson Mendonsa & Hamilton LLP

(57) ABSTRACT

A hooded sun shield includes a head piece including an opening, side vents and a plurality of fasteners, and a mask piece attachably coupled to the head piece via the plurality of fasteners over the opening, including a first layer and a second layer formed over the first layer, first layer and second layer form a horizontal vent in the mask piece.

11 Claims, 4 Drawing Sheets

(56) References Cited

U.S. PATENT DOCUMENTS

| | | | | |
|---|---|---|---|---|
| 5,881,389 | A * | 3/1999 | Fruge | A42B 1/046 2/202 |
| 6,269,489 | B1 * | 8/2001 | Heath | A42B 1/046 2/202 |
| 2006/0085881 | A1 * | 4/2006 | Gellis | A41D 13/1153 2/9 |
| 2006/0174890 | A1 * | 8/2006 | Cheng | A41D 13/11 128/206.19 |
| 2015/0113711 | A1 * | 4/2015 | Kim | A42B 1/205 2/424 |
| 2017/0079359 | A1 * | 3/2017 | Chase | A42B 1/0186 |
| 2018/0146733 | A1 * | 5/2018 | Greenblat | A42B 1/046 |
| 2019/0021428 | A1 * | 1/2019 | Page | A41D 23/00 |
| 2021/0392966 | A1 * | 12/2021 | Nguyen | A41B 3/00 |

OTHER PUBLICATIONS

Mesh, Lexico, accessed via https://www.lexico.com/en/definition/mesh (last visited Mar. 23, 2022) (Year: 2022).*

* cited by examiner

HOODED SUN SHIELD

CROSS REFERENCE

The present patent application claims the benefit of U.S. Provisional Application No. 62/930,274, filed Nov. 4, 2020, the entire contents of which are hereby incorporated herein by reference.

FIELD OF INVENTION

The present invention relates generally to sun protected clothing and accessories.

BACKGROUND

Sun protection is a fast growing area of interest for medical professionals and consumers. Protective products include sunscreen lotions and gels, sun protection fabrics, apparel and accessories. Recently, the sun protection market, particularly in outdoor sports, has seen the introduction of face buffs, or tubular, tight fitting, synthetic neck gators that are stretched and manipulated to be worn in various configurations to protect a portion of the user's face. Other sun protective clothing accessories include gloves and wide brimmed and long-billed hats.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figures 1A, 1B, 1C:
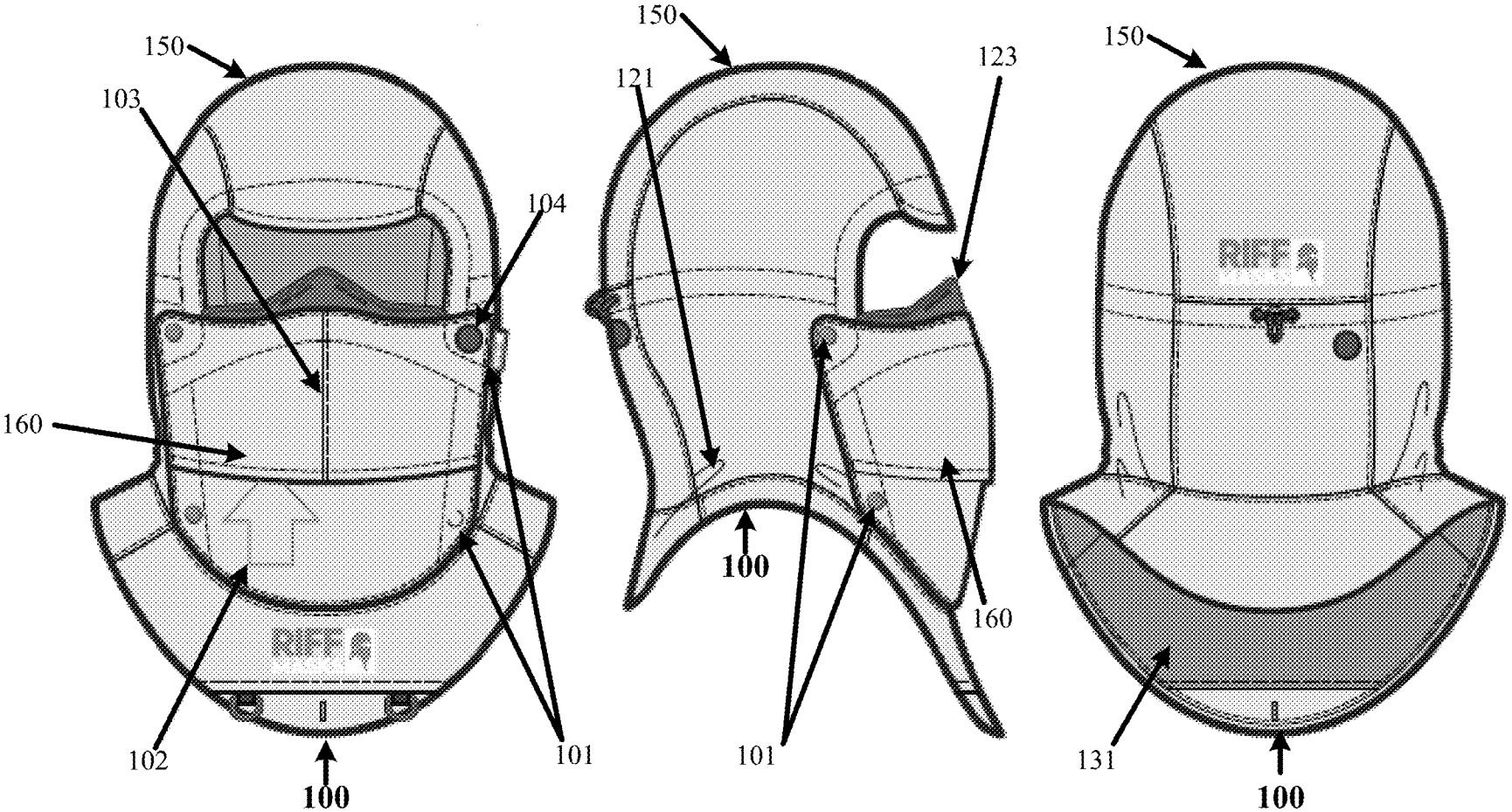
FIGS. 1*a*-1*c* illustrate one embodiment of a hooded sun shield.

Currently marketed sun protective apparel accessories are single-piece, lightweight, neck socks (buffs) that lie tightly against the skin, held in place by the elasticity of the fabric. The fabric's flushness on the skin and the tight-fitting nature of the garment can be restrictive to some; breathing from behind the buff can cause sunglasses to fog; and the tightness of the fabric often decreases comfort by increasing the body's temperature. Existing products do not provide full facial coverage nor protection from harmful reflective rays from sunglasses and water surfaces. Moreover, such products are not sufficient under power and in extreme conditions (e.g., as wind and high speeds in boats).

According to one embodiment, a hooded sun shield is provided to shield the face, neck and head from harmful sun rays during outdoor activities. In such an embodiment, the hooded sun shield comprises a two-piece configuration, including a head piece and a detachable mask piece. The head piece is fit over a head and includes side ventilation to provide air flow to the head. The mask piece is attachable, coupled to the head piece and comprises side vents to provide for comfortable breathing, airflow through the sides and reduction of fogging of eyewear. In a further embodiment, a nose piece is provided to sit on a top edge of the mask piece to operate as a guard against sun glare; thus reducing the effect of reflective sunburn. In a further embodiment, nose piece is configured to eliminate fogging of sunglasses worn by the user.

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements cooperate or interact with each other, but they may or may not have intervening physical or electrical components between them.

As used in the claims, unless otherwise specified the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

FIGS. 1*a*-1*c* illustrate one embodiment of front, side and back views, respectively, of a hooded sun shield 100. As shown in FIGS. 1, hooded sun shield 100 includes a head piece 150 and a mask piece 160. Head piece 150 includes an opening that is partially covered by mask piece 160. According to one embodiment, head piece 150 and a mask piece 160 are comprised of a sun protective fabric that provides protection from ultraviolet (UV) radiation. Both head piece 150 and mask piece 160 include elastic pieces 121 to attach to one another to prevent loss of mask piece 160 when not worn by the user.

Figure 2A:
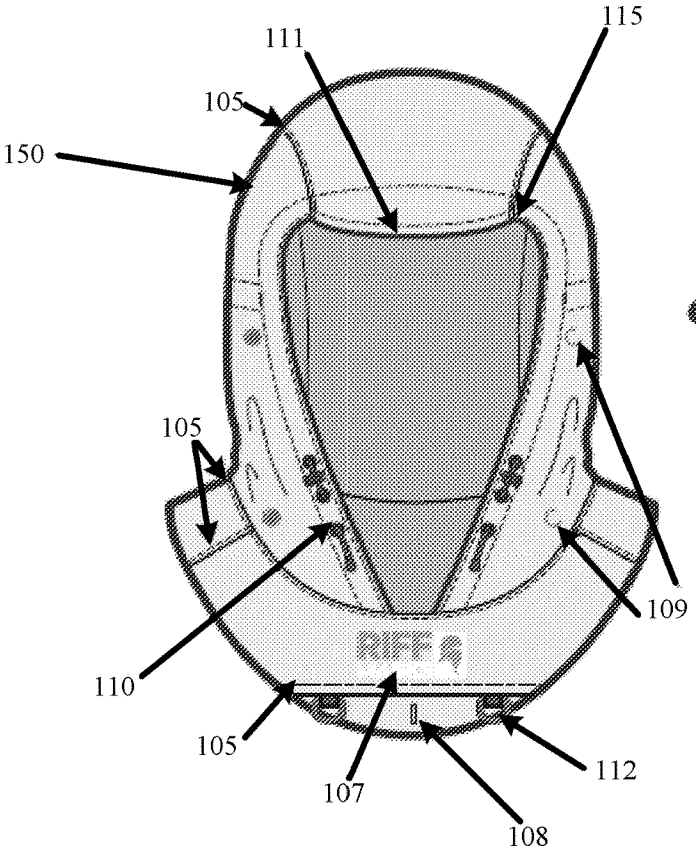
FIGS. 2*a*-2*c* illustrate one embodiment of a head piece.
Figure 2B:
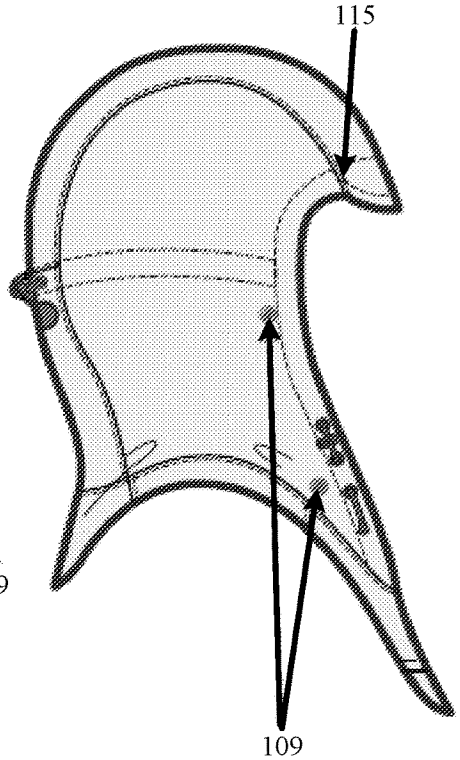
Figure 2C:
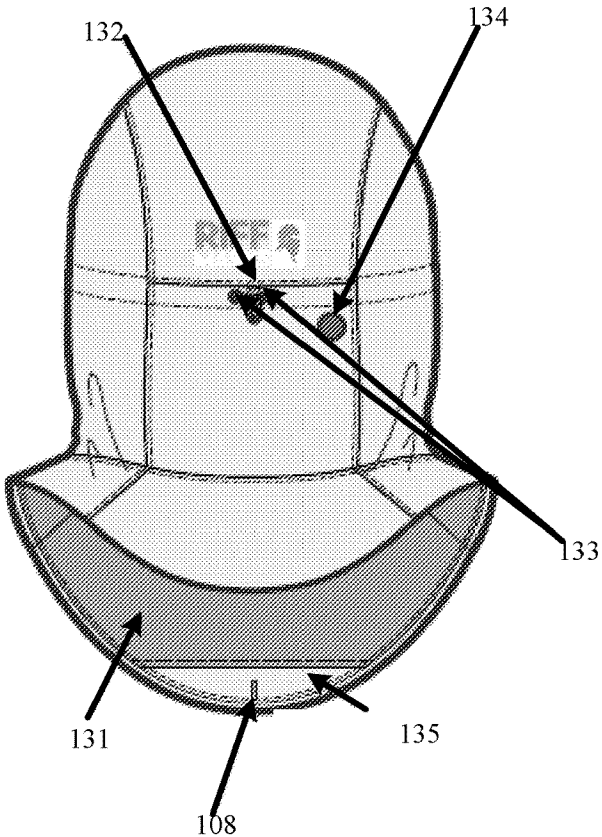

FIGS. 2*a*-2*c* illustrate one embodiment of front, side and back views, respectively, of a head piece 150. As shown in FIGS. 2, includes seams 105 constructed of the sun protective material. Additionally, head piece 150 includes fasteners 109 at each side to attach mask piece 160. In one embodiment, fasteners 109 may be implemented using rare earth magnets. However, fasteners may be implemented via other mechanisms (e.g., snaps, hook and loop fasteners, etc.).

According to one embodiment, head piece 150 is comprised of an exterior layer and an interior layer. In such an embodiment, the exterior layer is comprised of the sun protective fabric, while an interior layer 131 is comprised of a dark, sun protective fabric (e.g., different from the exterior layer fabric) to reduce glare and increase vision while the user is around a body of water (e.g., surfing. fishing, etc.). In a further embodiment, a buttonhole 108 is embedded through all layers to enable head piece 150 to be fastened to a user's shirt underneath head piece 150, as shown in FIG. 2*c*. Head piece 150 also includes D-rings 112 to which sunglasses, fishing tools (e.g. clippers, scissors, fishing leader spools) and other accessories can be attached.

In one embodiment, one or more bungee cords may be inserted into head piece 150 to provide structure and custom fitting to user's head. In such an embodiment, bungee stoppers 110 are incorporated at the bottom of head piece 150. The route of the bungee cords go below the stoppers 110 to the interior out through eyelets 133 at the back of head piece 150, where it is secured via a stopper 132. In a further embodiment, the bungee cord secures an internal brim 111 and a top seam 115 of head piece 150. A circle patch 134 is included at the back of head piece 150 to enable the attachment of mask piece 160 to head piece 150 whenever mask piece 160 is not in use. Additionally, the interior of head piece 150 includes a bottom panel 135 comprised of a shell fabric.

Referring back to FIG. 1, mask piece 160 is attached to head piece 150 via fasteners 101 located at the top and bottom corners of mask 160. As discussed above, the fasteners 101 may be implemented using rare earth magnets, or other fastening mechanisms. Mask piece 160 also includes a two-piece configuration that forms a horizontal vent 102 located across its length for ventilation and ease of breathing. In addition, the dimensions of mask piece 160 are greater than the dimensions of the opening of the hood piece, which create vertical slits, further facilitating the flow of breath and the movement of air through mask piece 160.

Figures 3A, 3B:
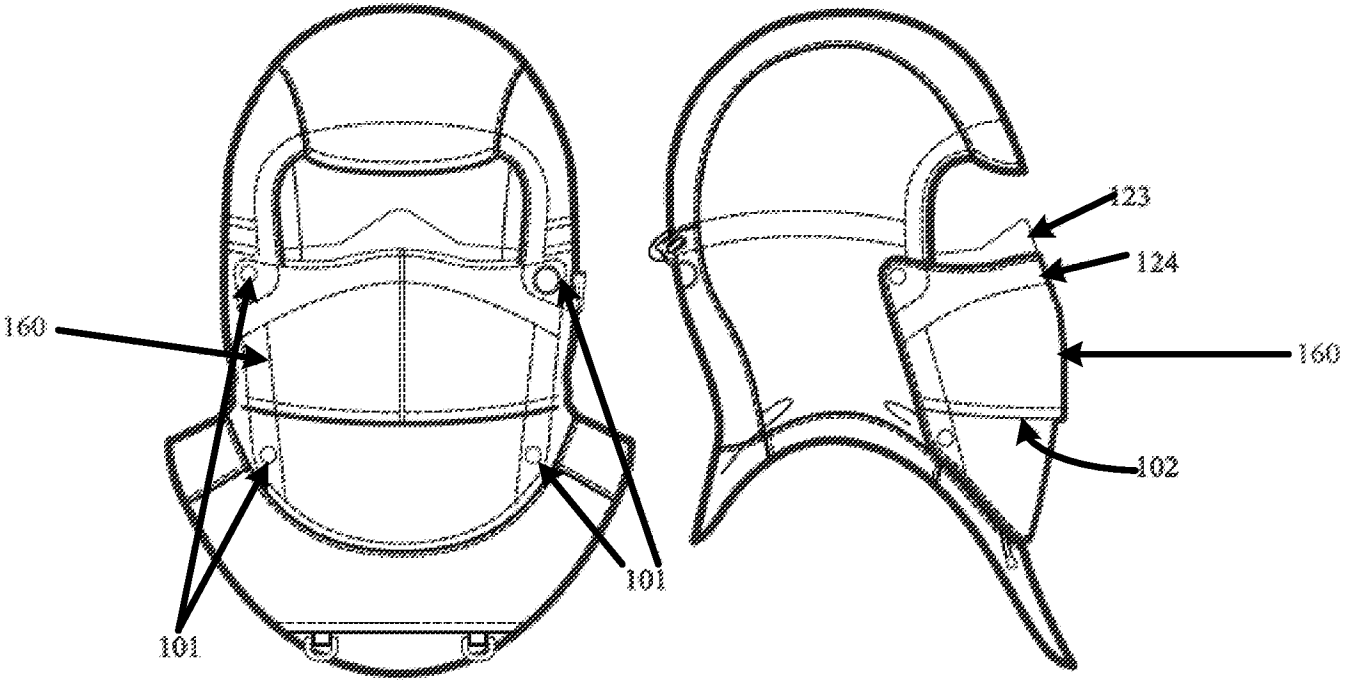
FIGS. 3*a* & 3*b* illustrate one embodiment of a mouthpiece.

In a further embodiment, mask piece 160 includes a center seam 103 to facilitate the mask piece 160 being shaped to fit a user's nose and convexity of the user's face. FIGS. 3*a* & 3*b* illustrate one embodiment of mask piece 160. As shown in FIGS. 3*a* & 3*b*, metal tabs are located at the interior of the top edge 124 of mask piece 160 to enable custom fitting to the user's nose contour. Additionally, a nose piece 123 may be inserted into mask piece 160 to securely fit the nose bridge of the user to provide further sun protection. In one embodiment, nose piece 123 is comprised of a synthetic rubber material, such as neoprene.

In a further embodiment, nose piece 123 includes a wire to enable nose piece 123 to be custom fitted to the user's nose and cheeks. Additionally, vent 102 is formed by a second layer formed on top of a first layer of mask piece 160. In such an embodiment, both the first layer and the second layer are comprised of a mesh material to provide ventilation and ease of breathing. In still a further embodiment, the routing of the bungee cords through to the eyelets 133 at the back of head piece 150, as shown in FIG. 2*c*, may be adjusted to seal nose piece 123 and prevent mask piece 160 from contacting the user's face; thus increasing air flow through hooded sun shield 100.

Figures 4A, 4B:
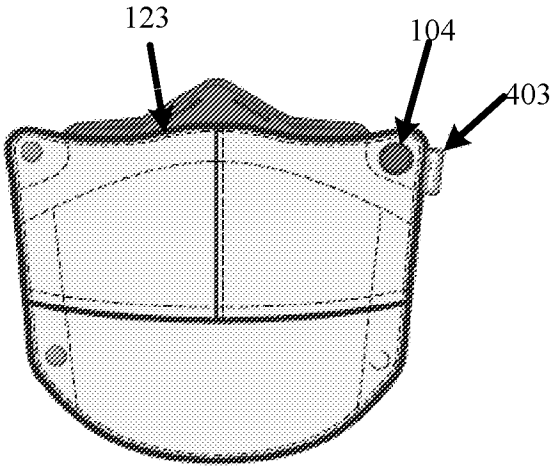
FIGS. 4*a* & 4*b* illustrate another embodiment of a mouthpiece.

FIGS. 4*a* & 4*b* illustrate another embodiment of mask piece 160. As shown in this embodiment, nose piece 123 is set into mask piece 160. Additionally, mask piece 160 includes an identifying label 403. FIG. 4*b* shows the interior of mask piece 160, in which a 2 part mesh layers includes an opening 404 to allow for access to place an object in the user's mouth (e.g., a straw for drinking, or food and/or drink). FIG. 4*b* also shows the adjustable metal tabs 405 that enable mask piece 160 to be custom fitted to the user's face.

The above-described hooded sun shield provides a novel sun protective accessory that provides full coverage of the face and head from the sun, as well as a breathing system for air flow and comfort.

The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

What is claimed is:

1. A hooded sun shield, comprising:

a head piece configured to extend over a user's head, including:

an opening configured to surround the user's face; and a mask piece attachably coupled outside of the head piece over a portion of the opening, including:

a fastener at each corner of the mask piece configured to connect the mask piece to the head piece, the fasteners arranged to create side openings at the left side and the right side of the mask piece between the mask piece and the head piece thereby forming a respective vertical slit at each side of the mask to facilitate ventilation for airflow; and a first continuous bendable metal tab on the left side between the fasteners;

a second continuous bendable metal tab on the right side between the fasteners;

each of the bendable metal tabs configured to facilitate custom fitting between the fasteners to maintain the side openings.

2. The hooded sun shield of claim 1, wherein dimensions of the mask piece are greater than dimensions of the opening of the hood piece.

3. The hooded sun shield of claim 1, wherein the fasteners comprise magnets.

4. The hooded sun shield of claim 1, wherein the head piece further comprises:

an exterior layer comprised of a sun protective fabric; and an interior layer comprised of a dark sun protective fabric.

5. The hooded sun shield of claim 2, wherein the mask piece further comprises a center seam to facilitate shaping of the mask piece.

6. The hooded sun shield of claim 5, wherein the mask piece further comprises medical wire located at a top edge of the mask piece to enable custom fitting of the mask piece.

7. The hooded sun shield of claim 6, further comprising a nose piece inserted into the mask piece.

8. The hooded sun shield of claim 7, wherein the nose piece is comprised of a synthetic rubber material.

9. The hooded sun shield of claim 4, wherein the exterior layer and the interior layer of the mask piece are comprised of a mesh material.

10. The hooded sun shield of claim 1, wherein the head piece comprises side vents to provide air flow.

11. The hooded sun shield of claim 1, wherein the head piece and mask piece each comprise:

a first layer; and a second layer formed over the first layer.

* * * * *